US006688027B2

(12) United States Patent
Fink

(10) Patent No.: US 6,688,027 B2
(45) Date of Patent: Feb. 10, 2004

(54) MULTIPURPOSE, RECONFIGURABLE MESSAGE BOARD FOR ROADSIDE EMERGENCIES

(76) Inventor: Frederick Fink, 21 Terrace Dr., Huntington Station, NY (US) 11746

( * ) Notice: Subject to any disclaimer, the term of this patent is extended or adjusted under 35 U.S.C. 154(b) by 0 days.

(21) Appl. No.: 09/983,104

(22) Filed: Oct. 23, 2001

(65) Prior Publication Data

US 2003/0074820 A1 Apr. 24, 2003

(51) Int. Cl.[7] ..... G09F 7/10; G09F 7/20

(52) U.S. Cl. ..... 40/611.08; 40/591; 40/597; 206/575

(58) Field of Search ..... 40/591, 593, 597, 40/611, 618, 611.01, 611.06, 611.08; 206/575

(56) References Cited

U.S. PATENT DOCUMENTS

| | | | | | |
|---|---|---|---|---|---|
| 3,307,026 | A | * | 2/1967 | Kramer | 362/191 |
| 3,936,967 | A | | 2/1976 | Davies | |
| 4,108,311 | A | * | 8/1978 | McClendon | 206/573 |
| 4,129,857 | A | | 12/1978 | Espinosa | |
| 4,208,820 | A | | 6/1980 | Cole | |
| 4,613,847 | A | * | 9/1986 | Scolari et al. | 340/473 |
| 4,858,082 | A | * | 8/1989 | Hayward | 362/542 |
| 5,131,177 | A | * | 7/1992 | Sy, Jr. | 40/593 |
| 5,241,768 | A | | 9/1993 | Thompson | |
| 5,430,965 | A | | 7/1995 | Lai | |
| 6,138,394 | A | * | 10/2000 | Sulenski | 40/591 |
| 6,178,679 | B1 | * | 1/2001 | Dundorf | 40/618 |
| 6,407,675 | B1 | * | 6/2002 | Mumford et al. | 340/907 |

FOREIGN PATENT DOCUMENTS

| | | |
|---|---|---|
| GB | 2 232 997 | 11/1990 |
| GB | 2 249 654 | 5/1992 |

* cited by examiner

*Primary Examiner*—Brian K. Green
(74) *Attorney, Agent, or Firm*—Siemens Patent Services, LC

(57) ABSTRACT

A selectively reversible message board has a first face of the message board which displays one or more message cards, either preprinted, containing common messages such as "OUT OF GAS", "FLAT TIRE", etc., or hand written. The message board may be reversed and the second face is adapted to receive a hand written message. Reversible suction cups are retained in keyhole shaped openings so as to minimize damage to the suction cup tabs when they are reversed. A flashing signal lamp is reversibly mountable on either face of the message board and serves to call attention to the message board and the stopped vehicle. The message board and accessories are provided in a kit contained in a reclosable bag. Storage inside the passenger compartments allows convenient configuration and deployment of the message board without need for any vehicle occupant to leave the vehicle.

13 Claims, 6 Drawing Sheets

MULTIPURPOSE, RECONFIGURABLE MESSAGE BOARD FOR ROADSIDE EMERGENCIES

This application is related to U.S. patent application Ser. No. 09/438,725, filed Nov. 10, 1999, now abandoned.

FIELD OF THE INVENTION

The present invention relates to signs and, more particularly, to a reconfigurable, multipurpose sign for automotive use for attracting help or informing responding aid personnel of the exact nature of the emergency, the whereabouts of the vehicle occupants, the specific nature of the help needed, etc.

BACKGROUND OF THE INVENTION

Typically, no two roadside emergencies are exactly the same. Even for similar, common emergencies or conditions, such as running out of fuel, the course of action taken by the driver and/or vehicle occupants may differ widely depending on the location of the emergency, the time of day or night, the weather, etc. Consequently, while various message systems have been proposed in the prior art, they all lack the flexibility to respond accurately to a wide variety of unique roadside situations.

DISCUSSION OF THE PRIOR ART

Many attempts have been made to provide signs and the like for use in summoning assistance to a disabled vehicle. U.S. Pat. No. 3,936,967, for EMERGENCY SIGN DEVICE, issued Feb. 10, 1997 to Charles H. Davis teaches one such device. DAVIS teaches a collapsible sign for erecting outside the motor vehicle, typically on the trunk or hood decks of the vehicle. The frame of the sign in retained in position on the deck by suction cups. A pair of slots on the sign surface accept pre-printed message cards such as "EMERGENCY", "OUT OF GAS", etc. Davis, however, teaches no way to provide a unique message specific to the current situation. In addition, to deploy the DAVIS sign, a vehicle occupant must exit the vehicle, extract the collapsed sign from the trunk and erect the sign on the hood or trunk deck. In foul weather, this exposes the occupant to the elements. In certain neighborhoods, or on certain roads having narrow shoulders, etc., egress from the vehicle may expose the vehicle occupant(s) to danger. Also, because the sign is mounted out-of-doors, the message cards must be weatherproof and the securement means of the sign frame must ensure their attachment even in high winds, etc. Any unique message that the vehicle occupant might choose to write would require a weather proof writing implement which would probably be in the form of a permanent, non-erasable marker, a device rarely carried by motorists. Sign cards written upon by such a marker would need to be replaced prior to the next roadside emergency.

In contradistinction, the message system of the present invention features a small sign board which may readily be carried in the glove box or under a seat of most vehicles, thereby eliminating the need to exit the vehicle. This is especially desirables in foul weather, in undesirable neighborhoods, or along roadways where the chances of being struck by a passing vehicle are high. While common, preprinted message cards are provided and may be easily used, other options are provided to the motorist. First, the sign board is reversible and has a first face adapted to receive a plurality of preprinted message cards. Blank message cards are also provided and the motorist may, optionally, select to write a custom message of one or more blank cards. These hand-written message cards may be displayed, either in combination with a preprinted card or alone. An erasable marker provided in the sign board kit facilitates this operation. Because the inventive sign board is displayed from inside the vehicle, weather conditions are of no concern, at least from the point of view of the sign.

However, assuming that a more detailed message may be required, the inventive sign board is reversible and the entire surface of a second face is adapted to receive a longer, hand-written message. Either face of the message board may be displayed in any convenient vehicle window by reversing a pair of suction cups.

Finally, unlike the DAVIS sign, a blinking strobe light is reversibly mounted to the sign to attract attention.

U.S. Pat. No. 4,129,857, for PORTABLE DRIVER EMERGENCY DEVICE, issued Dec. 12, 1978, to Albert Espinosa teaches another vehicle emergency signaling device. ESPINOSA teaches a self-supporting apparatus configured to be placed in either the front (i.e., against the windshield) or the rear windows of a vehicle. A pair of flashing lights are provided for calling attention to the vehicle. Also, the outward facing surface of the ESPINOSA apparatus is equipped to receive and retain one or more preprinted message cards. No provision is provided, however, for either hand-writing a message card of for placing a lengthy message on a second face of a sign. In addition, the ESPINOSA apparatus may not readily be mounted inside a side window of the vehicle because it must rest of a horizontal surface.

U.S. Pat. No. 5,430,965, for MESSAGE DISPLAY BOARD, issued Jan. 11, 1995, to Shih-Wang Lai discloses a single-sided message board having a self-contained writing implement and eraser. The board is adapted in a preferred embodiment for attachment to a front-facing surface of the vehicle's sun visor so that flipping down the sun visor to an operative position positions the LAI board against the vehicle's windshield. In an alternate embodiment, the LAI message board may be attached to any surface within the vehicle by suction cups. While LAI includes an illumination source designed to illuminate the message written on the board, he fails to teach any signaling device to attract attention to the vehicle. Neither does LAI provide a reversible message board wherein preprinted message cards may be displayed on the reverse face of the board. Unlike the keyhole-shaped suction cup mounting holes of the inventive message board, LAI provided circular holes. Circular holes provided the chance for damage to the suction cup mounting tabs, particularly after the polymeric suction cups have been stored within the vehicle at both high and low temperature extremes for a number of years.

UK Patent No. 2,249,654A, for A TICKETING SYSTEM, published May 13, 1992, upon application by Burns Phillip Hardware Ltd. teaches a sign adapted to slidably receive a variety of preprinted components which, when placed upon the sign board, form a reconfigurable sign. There is no teaching, however, of a reversible message board with may be mounted using suction cups inside a vehicle. There is no provision taught or suggested for attaching a flashing (i.e., strobe) light to attract attention to the sign.

UK Patent No. 2,231,192, published Nov. 18, 1990, upon application by Auxillium Line S. r. l. discloses a roof-mounted, collapsible emergency sign adapted to display interchangeable signaling boards containing symbols indicative of the reason for the vehicle stopping (i.e., the nature of the emergency). No flashing light is provided nor is there any provision for displaying a hand written message on a reverse face of the sign. The sign is mounted outside the vehicle.

U.S. Pat. No. 4,108,311, for SAFETY WARNING KIT, issued Aug. 22, 1978, to Gilbert McClendon teaches a kit containing a display pole and a collection of flags each having a preprinted message relevant to a disabled vehicle. The pole may be deployed outside the vehicle and an appropriate flag selected and displayed. No provision is made for a hand written message. Neither is there any provision for a flashing signal beacon to attract attention to the disabled vehicle.

U.S. Pat. No. 5,421,768, for MESSAGE HOLDER, issued Sep. 7, 1993, to James A. Thompson teaches a transparent plastic holder adapted to receive a single bumper sticker. Suction cups hold the THOMPSON device against the rear window of an automobile. THOMPSON teaches no kit containing preprinted messages or a surface suitable for hand writing a message. Neither does THOMPSON provide a blinking strobe type light for calling attention to a disables vehicle.

U.S. Pat. No. 4,208,820, for SIGNS FOR DISABLED MOTORIST, issued Jan. 24, 1980, to Edwin L. Cole teaches a collection of preprinted signs fastened together. A disables motorist can flip through the sign collection, select a suitable sign and then hang the sign collection from the rear bumper of the automobile or otherwise display the sign. COLE teaches no support plate for holding a selected, preprinted sign card. Neither does cole provide a surface upon which to write a handwritten message. The COLE sign is typically displayed outside the vehicle and is limited by all the drawbacks associated with external display.

None of these patents, singly or in any combination, are seen to either teach or suggest the two-sided, reversible message board of the instant invention.

It is therefore an object of the invention to provided a two-sided, reversible message board which may be displayed from within a motor vehicle.

It is another object of the invention to provide a two-sided, reversible message board which may display a combination of preprinted message cards.

It is also an object of the invention to provide a two-sided, reversible message board which may be displayed from within a motor vehicle hand-written message card(s), alone or in combination with preprinted message cards.

It is an additional object of the invention to provide a two-sided, reversible message board having a reverse face upon which a detailed message may be inscribed with an erasable writing implement.

It is yet another object of the invention to provide a two-sided, reversible message board which may be displayed from within a motor vehicle which includes a detachable, reversible flashing lamp to attract attention to the vehicle.

It is another object of the invention to provide a two-sided, reversible message board which may be displayed from within a motor vehicle which is selectively attached to the vehicle by reversible suction cups.

It is also an object of the invention to provide a two-sided, reversible message board in which reversible suction cups are retained in keyhole shaped opening so that damage to the suction cups is minimized when the suction cups are reversed.

It is a still further object of the invention to provide a two-sided, reversible message board in a kit containing a selection of preprinted message cards, blank message cards, an erasable marker, and a cloth or eraser packaged in a reclosable container.

It is yet another object of the invention to provide a two-sided, reversible message board in a kit which may be conveniently stored within the passenger compartment of a motor vehicle.

SUMMARY OF THE INVENTION

The present invention features a selectively reversibly message board for use in a motor vehicle. A first face of the message board is adapted to receive one or more message cards. These message cards may be either preprinted containing commonly needed messages such as "OUT OF GAS", "FLAT TIRE", etc. In addition, an erasable marker may be used to write a short message on a blank message card which may be displayed alone or in combination with one or more preprinted cards. The message board may be reversed and the second face is adapted to receive a longer, hand written message. Reversible suction cups are retained in keyhole shaped openings so as to minimize damage to the suction cup tabs when they are reversed. A reversible flashing strobe type signal lamp is mountable on either face of the message board and serves to call attention to the message board and the stopped vehicle. The inventive message board is provided in a kit contained in a reclosable bag. The compact size of the kit facilitates storage of the kit within the passenger compartment in the glove box, under a seat, etc. Storage inside the passenger compartments allows configuration and deployment of the message board without need for any vehicle occupant to leave the vehicle. This is particularly desirable in inclement weather, in a dangerous neighborhood, or along a dangerous road such as a road having very narrow shoulders.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Generally speaking this invention relates to a message board for use within a disabled motor vehicle. Although a disabled motor vehicle has been chosen for purposes of disclosure, it will be recognized that the inventive message board system will be useful in other environments and applications. The invention is not, therefore, considered limited to use in a motor vehicle.

Figure 1:
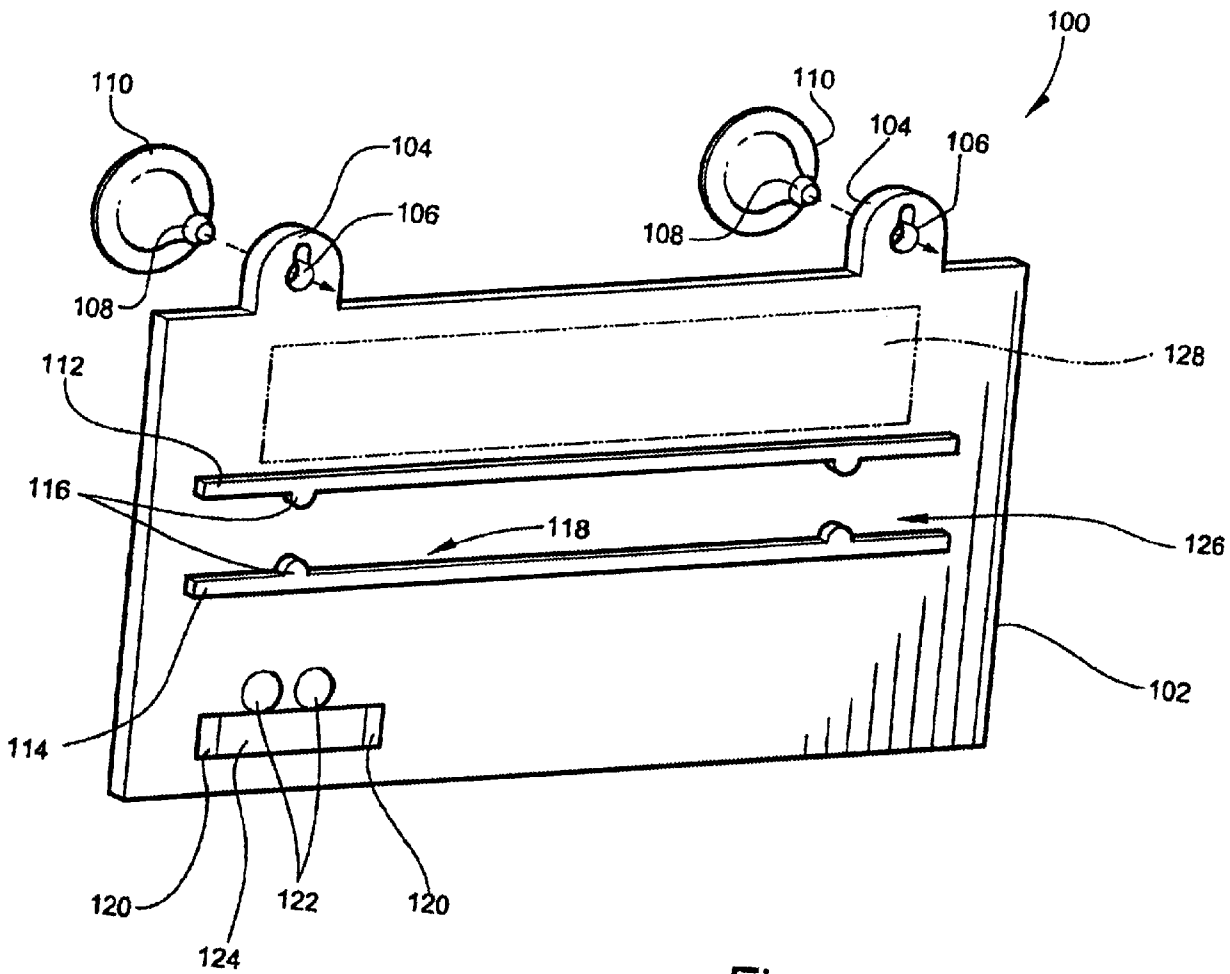
FIG. 1 is a perspective view of a first face of the reversible message board of the invention.

Referring first to FIG. 1, there is shown a perspective view 100 of a first face of the inventive message board. Message board 102 is a thin, planar, substantially rectangular piece of plastic. Message board 102 may be formed from a variety of different polymers such as are known to those skilled in the plastics art. In the embodiment chosen for purposes of disclosure, message board 102 is formed from high impact styrene.

A pair if semicircular protrusions 104 are formed at opposite ends along the top edge of message board 102. Protrusions 104 have keyhole shaped openings 106 formed in their central regions. Keyhole openings 106 are adapted to reversibly receive tabs 108 of suction cups 110. In other words, suction cups 110 may be attached to message board 102 from either side. Because message board 102 is designed for display from either direction, it is assumed that suction cups 110 will be attached and detached from message board 102 periodically. While a simple, circular hole (hot shown) could be used to retain tabs 108, over time there is a significant chance of damage to tabs 108 of suction cups 110. Keyhole openings 106 minimize the chance for damage to tabs 108. It would certainly be evident to one skilled in the art that keyhole openings 106 could receive a variety of different hanging devices other than suction cups, such as, but not limited to, Velcro® fasteners or thin wire or sheet metal hooks for hanging over the top of a window or door. It would likewise be evident that a device such as, but not limited to, an easel or flip out support brackets could be used to maintain message board 102 in an upright position on a substantially flat surface.

Figure 3A:
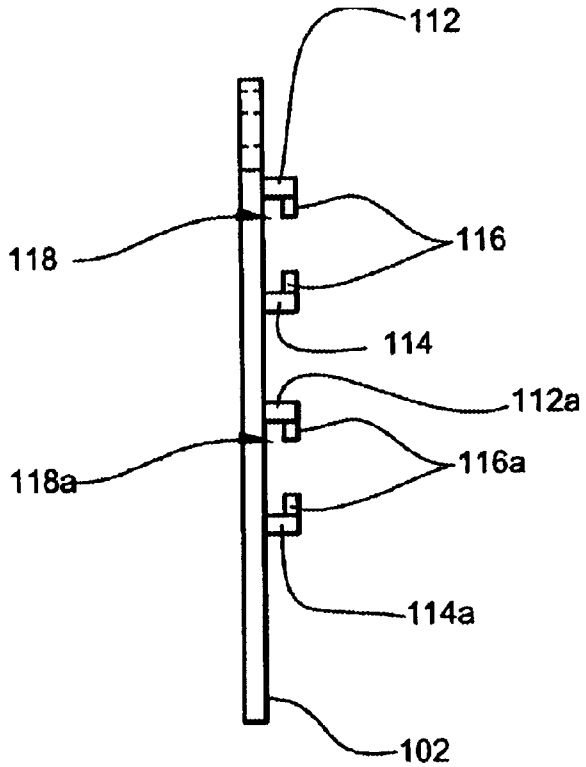
FIG. 3*a* is a side elevational view of the message board shown in FIGS. 1 and 2, having additional pairs of hanging rails.

An upper rail 112 and a lower rail 114 are disposed across the face of message board 102 along its long axis. Retention tabs 116 are placed periodically along rails 114, 116 defining a channel 118 therebetween. Channel 118 is configured to slidably receive from either end, an interchangeable message card 142, 146 (FIG. 5), typically as shown by arrow 126. While a single pair of rails 112, 114 have been shown in FIG. 3, it will be recognized that additional rail pairs could be added to message board 102 to allow retention and display of additional message cards. FIG. 3*a* illustrates additional pairs of rails 112*a* and 114*a,* forming channel 118*a,* for the retention and display of additional message cards. In still other embodiments, rails 112, 112*a,* 114, and 114*a* could also be configured to have retention tabs 116 and 116*a* on both a top and bottom surface thereby functioning as both a top rail 112, 112*a* and a bottom rail 114, 114*a.*

Figure 4C:
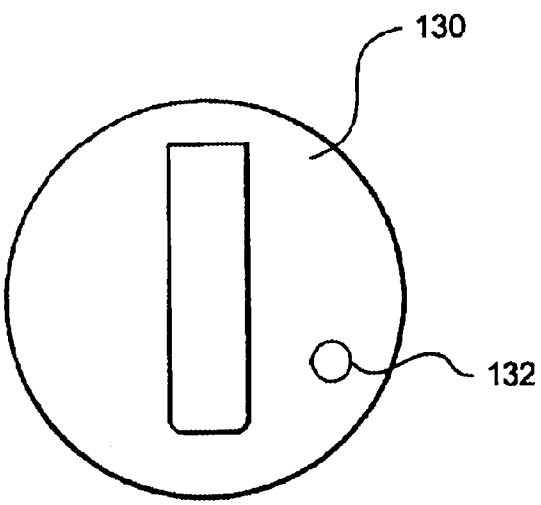
FIGS. 4*a*, 4*b* and 4*c* are front, side and rear views, respectively of a blinking strobe light assembly for use with the message board of FIGS. 1 and 2.
Figure 4B:
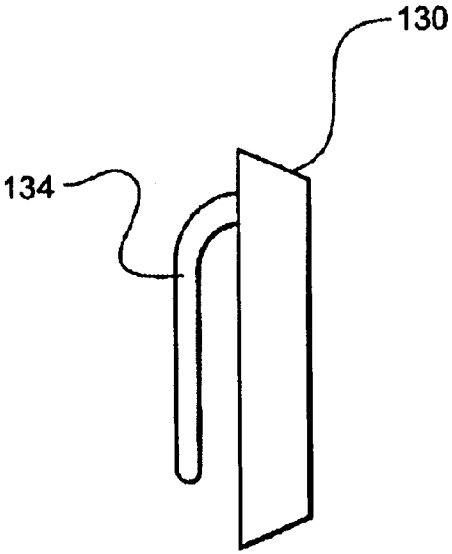
Figure 4A:
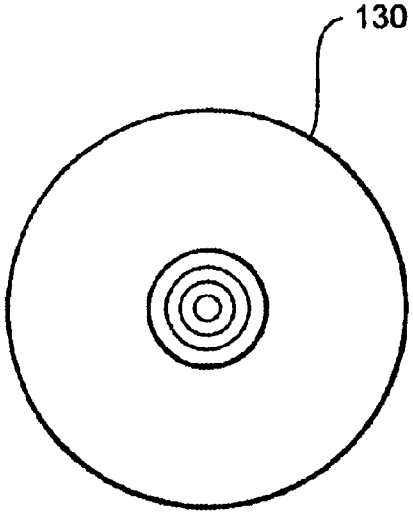

Refer now also to FIGS. 4*a*, 4*b* and 4*c*. A pair of rectangular holes 120 are provided for mounting a light signal device, typically a clip-on flashing strobe light assembly 130 to either face of message board 102. Clearance holes 122 provide access to an on/off switch 132, typically located on the rear surface of strobe light assembly 130. A clip assembly 134 may be slid through one of the rectangular holes 120 to retain strobe light assembly flush against the desired surface of message board 102. A recessed region 124 may optionally be provided to receive clip assembly 134. A beveled edge may be provided on each rectangular hole 120 to ease insertion of clip 134 into holes 120. In alternate embodiments, message board 102 may be adapted to only receive and accommodate strobe light assembly on a single face. In this embodiment, one of the rectangular holes 120 (depending upon which face of message board 102 was to receive strobe light assembly 130) and its corresponding clearance hole 124 could be eliminated.

Strobe light assembly 130 is a readily available, commercial product widely distributed for use by bicyclers, walkers, etc. It will be recognized that other configurations of both blinking and steady light sources could be used with the message board by making suitable changes to rectangular holes 120 and/or access holes 122. It will also be recognized that the exact location of access holes 122 relative to the respective rectangular hole 120 will be determined by the exact configuration of strobe light assembly 130.

Strobe light assembly 130 may, of course, be removed from message board 130 and affixed to the clothing of a vehicle occupant. This may be useful when the occupant is called upon to change a tire or otherwise engage in activity outside the vehicle.

It would be evident to one skilled in the art that strobe light assembly 130 may, optionally, also contain an illuminating beam for illuminating message board 102 or that a separate illuminating lamp assembly could be incorporated into message board 102.

A region 128 on the face of message board 102 is shown wherein permanent indicia could be displayed. A pertinent message such as HELP, could likewise be permanently displayed. Other potential uses for region 128 could be to display a company's logo or possibly other advertising material. Region 128 may also be left blank and a short, hand written message may be inscribed by a user of the message board 102.

Figure 2:
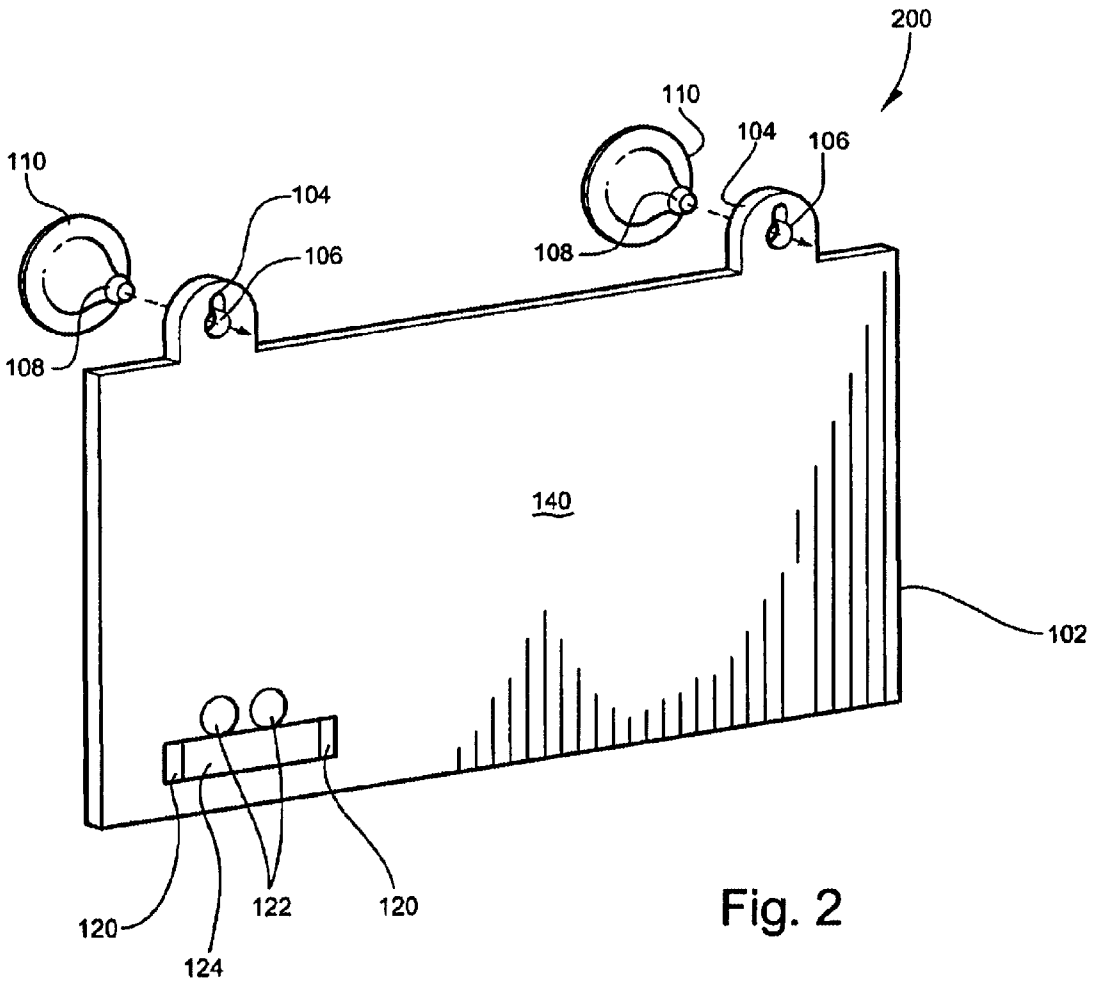
FIG. 2 is a perspective view of an opposite face of the message board of FIG. 1.

Referring now also to FIG. 2, there is shown a perspective view 200 of the reverse face of the inventive message board 102 (FIG. 1). Absent from the reveres face are rails 112, 114 leaving a solid, contiguous surface 140 adapted to receive a hand written message. Suction cups 110 may, as shown, be reversed from the orientation shown in FIG. 1 thereby allowing selectively displaying either the first face (FIG. 1) or the reverse face (FIG. 2) of the message board 102.

Figure 3:
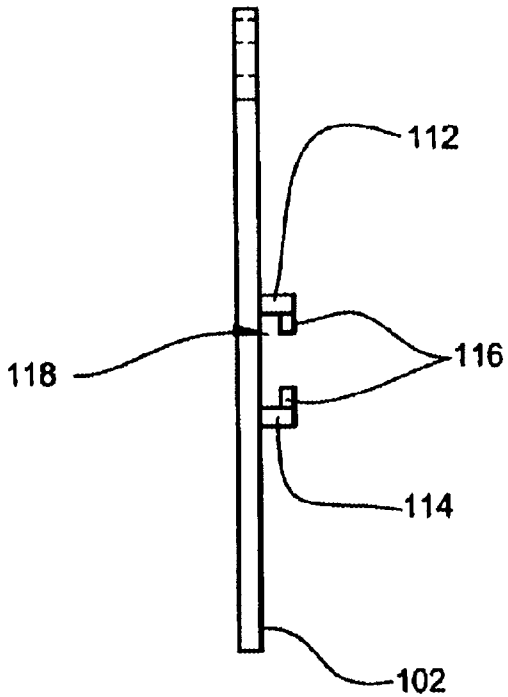
FIG. 3 is a side elevational view of the message board shown in FIGS. 1 and 2.

Referring now to FIG. 3, there is shown a side elevational view of the message board of FIGS. 1 and 2. Channel 118 formed by top rail 112, bottom rail 114 and retention tabs 116 may readily be seen.

Figure 5:
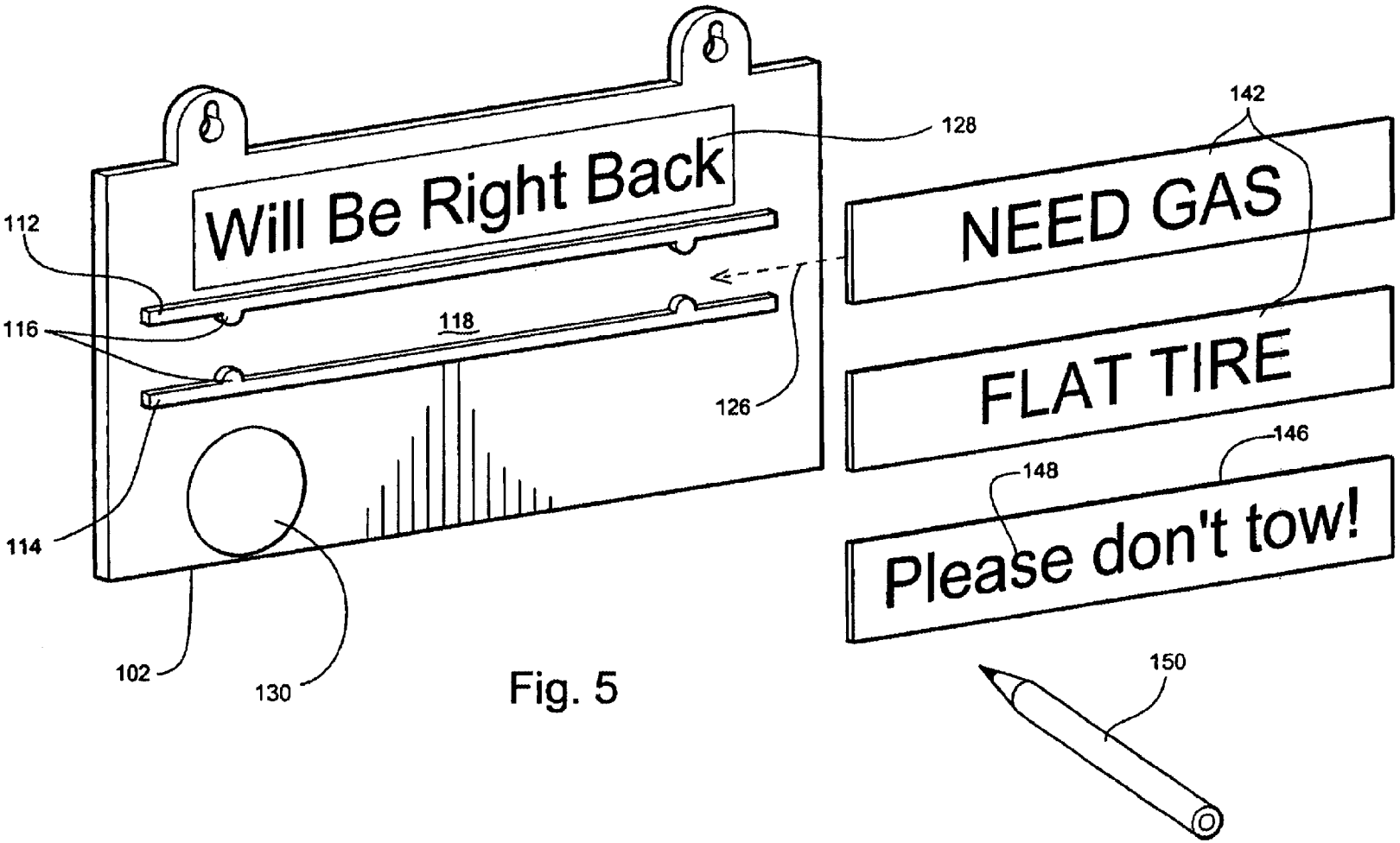
FIG. 5 is an exploded, perspective view of the message board as shown in FIG. 1 showing interchangeable message cards.

Referring now to FIG. 5, there is shown an exploded, schematic view of the message board 102 as shown in FIG. 1. Two preprinted message cards 142 are shown poised for insertion into channel 118 as indicated by arrow 126. Only one of the preprinted message cards 142 will normally be inserted at any given time into channel 118. In alternate embodiments, the depth of channel 118, controlled by the height of top rail 112 and bottom rail 114 could be configured to receive more than one preprinted card 142 thereby allowing storage of alternate preprinted messages cards 142 behind the preprinted message card 142 currently being displayed.

A blank message card 146 having a hand written message 148 inscribed thereupon using erasable marker 150 or another suitable writing instrument (not shown) for the purpose.

Message cards 142, 146 may be formed from bristol board or another similar paper or cardboard product, or from a polymer, Teflon® being preferred for ease of sliding message cards 142 into channel 118. Blank message card 146 must have at least one surface adapted to receive a message written by erasable marker 150.

It would be evident to one skilled in the art that the inventive message board 102, message cards 142, 146 and strobe light assembly 130 could be formed of magnetic or "cling" materials in lieu of those described hereinabove.

Figure 6:
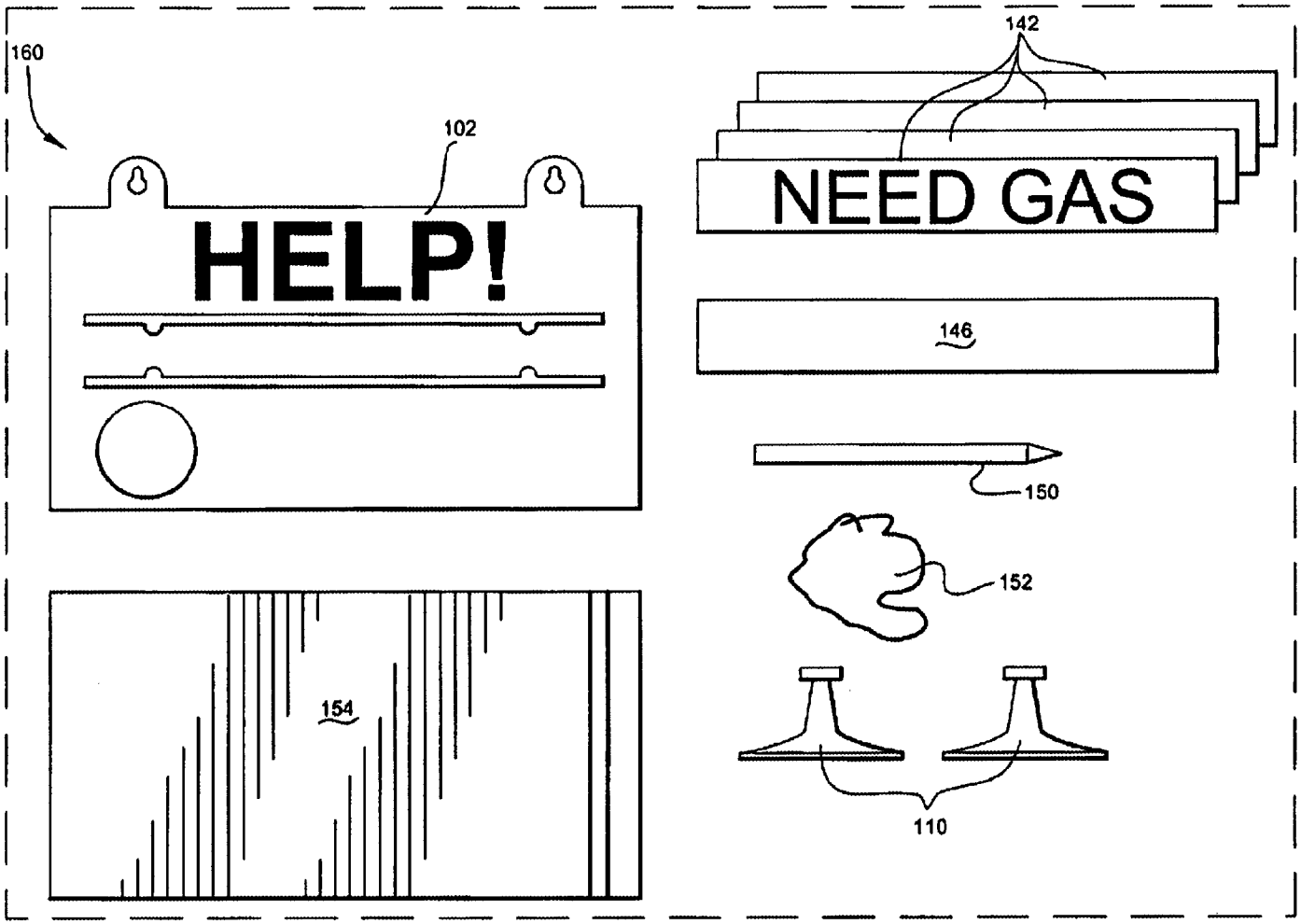
FIG. 6 is a perspective, schematic view of a kit containing the various components for use with the message board of the invention.

The inventive message board is typically provided in a kit 160 as shown in FIG. 6, The message board 102, a number of preprinted message cards 142, at least one blank message card 146, a pair of suction cups 110, an erasable marker 150 and an eraser (not shown) or a suitable erasing cloth 152 are all packaged in a reclosable plastic bag 154. The size of message board 102 has been chosen to allow kit 160 to be readily stored in the glove box of a typical automobile. If the glove box is extraordinarily small, kit 160 may readily be stowed under a seat. Having the message board system available without having to leave the vehicle is considered highly desirable for reasons enumerated hereinabove.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. A reversible, reconfigurable message display apparatus for removable attachment to a surface, comprising:

a) a thin, substantially planar, substantially rectangular message board having a first face and a second face, said first face being equipped with means for retaining at least one message card thereupon and said second face being adapted to receive a hand written message thereupon, said message board comprising means for selectively and reversibly mounting said message board to a surface;

b) a plurality of message cards, at least one of said message cards containing a preprinted message, each of said message cards being adapted for retention upon said first face of said message board;

c) a flashing strobe light signal removably and selectively affixable to said first face and said second face of said message board, d) an attachment means for removably securing said flashing strobe light signal to an article of clothing worn by a person, said flashing strobe light signal serving as a safety beacon for said person.

2. The reversible, reconfigurable message display apparatus for removable attachment to a surface, as recited in claim 1, wherein said means for retaining at least one message card upon said first face of said message board comprises at least one pair of substantially parallel, spaced-apart rails disposed thereupon along a long axis thereof and substantially parallel to an edge thereof, said pair of spaced-apart rails defining a channel therebetween adapted to slidably receive and retain at least one of said message cards.

3. The reversible, reconfigurable message display apparatus for removable attachment to a surface, as recited in claim 2, wherein at least one rail of said pair of substantially parallel, spaced-apart rails comprises a retention tab to facilitate defining said channel.

4. The reversible, reconfigurable message display apparatus for removable attachment to a surface, as recited in claim 2, wherein said pair of substantially parallel, spaced-apart rails comprises at least two pairs of substantially parallel, spaced-apart rails, said pairs of rail being disposed substantially parallel to one another.

5. The reversible, reconfigurable message display apparatus for removable attachment to a surface, as recited in claim 1, wherein said means for selectively and reversibly mounting said message board to a surface comprises at least one suction cup adapted for reversible attachment to said message board; whereby said message board may be mounted to said surface with a selected one of said front face and said back face being outwardly oriented.

6. The reversible, reconfigurable message display apparatus for removable attachment to a surface, as recited in claim 5, wherein said at least one suction cup comprises two suction cups disposed proximate a top edge of said message board, each of said at least one suction cups each being removably retained in a keyhole-shaped hole in said message board proximate said top edge thereof.

7. The reversible, reconfigurable message display apparatus for removable attachment to a surface, as recited in claim 6, wherein said first face of said message comprises an area adapted to display permanent indicia.

8. The reversible, reconfigurable message display apparatus for removable attachment to a surface, as recited in claim 7, wherein said permanently displayed indicia comprises at least one of the group: a permanently displayed message, a company logo, an advertising message, and an erasable, hand written message.

9. The reversible, reconfigurable message display apparatus for removable attachment to a surface, as recited in claim 1, wherein said flashing strobe light signal comprises an on/off switch.

10. The reversible, reconfigurable message display apparatus for removable attachment to a surface, as recited in claim 9, wherein said message board is adapted and configured for use in a disabled vehicle and wherein said at least one preprinted message card contains a message pertinent to a disabled vehicle.

11. A reversible, reconfigurable message display kit for removable attachment to a surface, said kit containing:

a thin, substantially planar, substantially rectangular message board having a first face and a second face, said first face being equipped with means for retaining at least one message card thereupon and said second face being adapted to receive a hand written message thereupon, said message board comprising means for selectively and reversibly mounting said message board to a surface;

a plurality of message cards, at least one of said message cards containing a preprinted message, each of said message cards being adapted for retention upon said first face of said message board;

a light signal removably and selectively affixable to said first face and said second face of said message board, and wherein said light signal comprises a flashing light signal, an erasable marker and an erasing cloth, and a package for containing said message board, said message cards, said flashing light signal, said means for selectively and reversibly mounting said message board to a surface, said erasable marker and said erasing cloth for storage within the passenger compartment of a motor vehicle.

12. The kit as recited in claim 11, wherein said package is in the form of a storage container for storing the contents of said kit.

13. The kit as recited in claim 12, wherein said package is in the form of a reclosable bag.

* * * * *